United States Patent [19]

Lesner

[11] 3,943,800

[45] Mar. 16, 1976

[54] PORTABLE SCREW DRIVING TOOL HAVING SCREW DEPTH CONTROL FEATURE

[75] Inventor: Richard S. Lesner, Bloomfield Hills, Mich.

[73] Assignee: Chicago Pneumatic Tool Company, New York, N.Y.

[22] Filed: Feb. 18, 1975

[21] Appl. No.: 550,264

[52] U.S. Cl. ..... 81/52.4 R
[51] Int. Cl.[2] ..... B25B 23/142
[58] Field of Search ..... 81/52.4 R; 144/32; 145/50.3, 50.5, 51, 52

[56] References Cited

UNITED STATES PATENTS

| | | | |
|---|---|---|---|
| 2,327,074 | 8/1943 | Snyder | 144/32 |
| 2,840,126 | 6/1958 | Schmitt | 145/52 |

FOREIGN PATENTS OR APPLICATIONS

| | | | |
|---|---|---|---|
| 372,622 | 11/1963 | Switzerland | 144/32 |
| 404,557 | 1/1934 | United Kingdom | 145/50 F |

*Primary Examiner*—James L. Jones, Jr.
*Attorney, Agent, or Firm*—Stephen J. Rudy

[57] ABSTRACT

A hand held power driven screw driving tool having a spring disengageable driving clutch and a retractible nosepiece for receiving a screw to be driven by a bit attached to a driven member of the clutch, there being associated with the nosepiece an adjustable travel control nut engaging a retractible sleeve projecting from the nosepiece, the nut being cooperable with a stop within the housing of the tool upon retraction of the sleeve to a preadjusted limit to curb the driving action of the tool and to allow disengagement of the clutch as the screw is finally entered into the work.

7 Claims, 6 Drawing Figures

PORTABLE SCREW DRIVING TOOL HAVING SCREW DEPTH CONTROL FEATURE

BACKGROUND OF THE INVENTION

This invention relates to improvements in power driven screw driving tools, particularly the hand held type. More particularly, it is concerned with an improved retractible nosepiece for the tool.

The improvement is a screw travel control feature incorporated in the nosepiece which is operable during a screw driving operation to control the depth to which the screw may be entered into the work.

The control feature is of an adjustable nature. It may be adjusted as needed to enable a screw to be seated to a precise depth relative to the work surface.

A desirable advantage of the improvement is that it enables the tool to drive a screw into the work to a point where the head of the screw has a precise seated relation to the surface of the work.

In accordance with the invention, there is provided a screw driving tool comprising a housing, a screw driving bit supported in the housing so as to follow as a unit with the housing a screw as it is being driven by the bit into a work surface, a slide member supported by the housing for relative axial retractible movement having a normal position projecting axially beyond the housing and the bit and adapted to be retracted into the housing relative to the housing and bit upon being pressed into contact with a work surface, and stop means carried by the housing having cooperation with the slide member to limit the extent of retraction of the slide member into the housing.

DESCRIPTION OF PREFERRED EMBODIMENT

Figure 1:
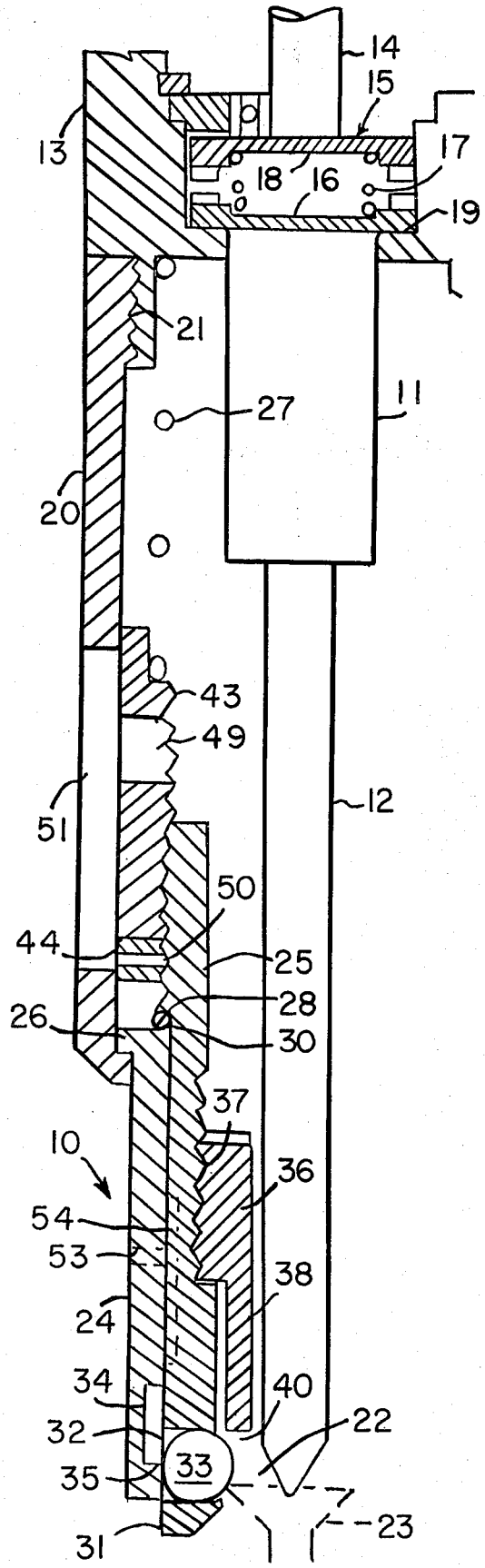
FIG. 1 is a longitudinal fragmentary sectional view of a hand held power driven screw driving tool in which a retractible nosepiece embodying the invention is shown at rest in its normal position; only so much of the tool and nosepiece is shown as is needed to explain the invention.

Reference is now directed to the accompanying drawing wherein the improved retractible nosepiece 10 is illustrated in association with a conventional hand held power driven screw driving tool in which a spindle 11 carrying a screw driving bit 12 is axially slidable relative to the housing 13 of the tool; and wherein the drive shaft 14 of a rotary motor is associated with the spindle by means of an axially disengageable clutch 15.

The spindle carries at its rear a face-jaw driven clutch member 16 which is engageable against the bias of a clutch spring 17 with an opposed face-jaw driving clutch member 18. The latter is connected with the drive shaft 14 of the motor and is restrained against axial movement relative to the housing.

The spindle has a normal position as in FIG. 1, wherein a shoulder of the spindle rests upon a shoulder 19 of the housing under the bias of the clutch spring, the latter normally holding the driven clutch member disengaged from the driving clutch member. The spindle is retractible relative to the housing and the clutch spring to engage the clutch members.

The nosepiece includes a supporting coupling 20 whereby it is removably attached as a unit to the front end or bottom of housing 13 in axial extension of the latter. The coupling has a threaded connection at 21 with the housing. The nosepiece defines a central passage 22 into which a headed screw 23, intended to be driven, may be entered for engagement with the bit. The entrance to the nosepiece has a coned surface as a guide to facilitate entry of the screw head first. The tip of the bit extends proximate the entrance where it may be visibly engaged with the head of the screw.

The nosepiece includes in slidable relation to one another, and to the housing and coupling 13, 20, a cylindrical outer or ball release sleeve member 24, and a cylindrical inner or ball holding slide or sleeve member 25.

The outer sleeve 24 extends slidably and axially through an open bottom end of the coupling; and it is limited in its extended normal position (as in FIG. 1) by abutment of a flange 26 about its upper end upon an internal shoulder of coupling 20.

The inner sleeve 25 extends slidably through the outer sleeve. It has a normal position under the bias of a return compression spring 27 in which a shoulder 28 intermediately of its ends abuts upon and exerts a compressive force upon a resilient element, such as a rubber O-ring 30, seated atop the flange 26 of the outer sleeve. In the normal or extended position of the inner sleeve its nose end 31 protrudes out of and beyond the bottom or front end of the outer sleeve (as shown in FIG. 1).

The inner sleeve has near its lower end a group of ball pockets or holes 32 (here three, one being shown) extending radially through its side wall. The several holes lie in the same plane, and are spaced circumferentially equally apart. A locking ball 33 is disposed in each hole. Each ball is of greater diameter than the radial extent of the hole.

An inturned lip about the inner edge of each hole prevents the ball from dropping out of the hole into passage 22. When the ball limits against the lip it protrudes into the passage, and its opposite surface protrudes slightly beyond the inner diameter of the outer sleeve.

The inner sleeve has limited axial travel relative to the outer sleeve as determined by the cooperation of the balls with either the upper or lower annular edge of an annular internal groove 34 in the outer sleeve. In the extended normal position of the inner sleeve (as in FIG. 1) its forward end protrudes beyond the outer sleeve and the balls are locked against or limit upon the lower annular edge 35 of the groove. In this extended position of the inner sleeve, the balls protrude into the central passage 22 to define a releasable throat or restriction of lesser diameter than the head of the screw 23 so as to normally block passing of the screw head into the central passage beyond the balls.

Figure 2:
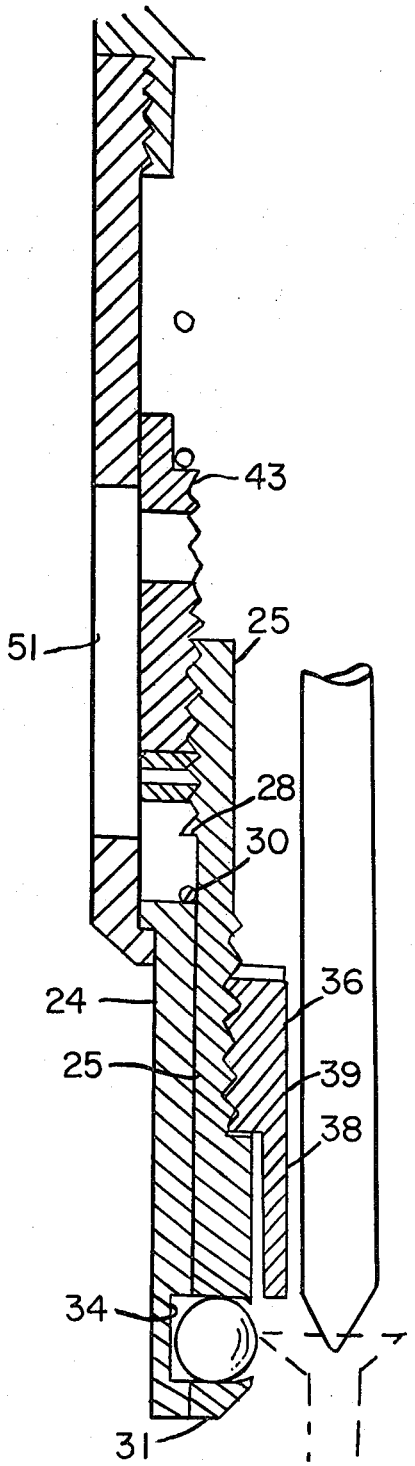
FIG. 2 is a detail showing the unlocked or ball released condition of the nosepiece in which condition the head of a screw may be passed in either direction beyond the locking balls.

The inner sleeve 25 has a retracted second position in which its normally protruding nose end 31 is flush with that of the outer sleeve, and in which position the several balls are registered with and movable into the groove 34 of the outer sleeve upon inward movement of the head of the screw (as in FIG. 2). The groove is deep enough in its radial dimension to allow the balls to be moved out of the central passage sufficiently to permit the head of the screw to pass in either direction beyond the balls.

A back-up ring nut 36 is disposed in the central passage 22 in coaxial surrounding relation to the driving bit and with clearance from the latter. It has a threaded rear portion engaged at 37 with an internal threaded portion of the inner sleeve. It has a forwardly extending skirt 38, against the forward or bottom end of which the head of a screw passed sufficiently beyond the balls is adapted to abut. The back-up nut 36 serves to provide a uniform backing support to the head of the screw as the latter is being initially driven by the bit.

Figure 3:
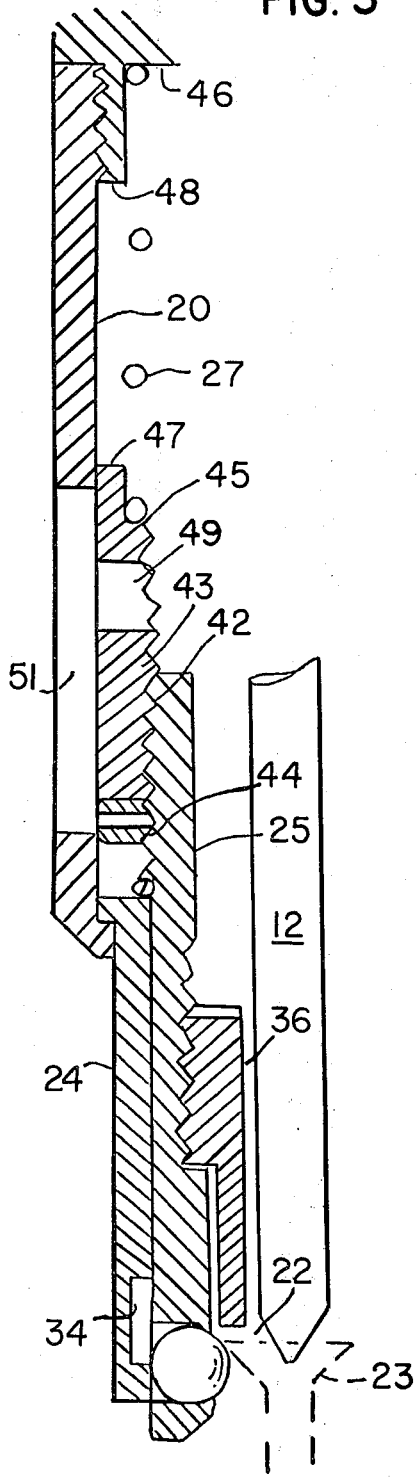
FIG. 3 is a detail showing the nosepiece in gripping relation to the head of a screw entered into the nosepiece beyond the balls.

The back-up nut has a forwardly limited position relative to a shoulder 39 of the inner sleeve to provide a predetermined clearance 40 between the forward end of the nut and the balls. This allows reception with some tolerance between the nut and the balls of a screw head of a predetermined thickness after the head of the screw has been moved rearwardly beyond the balls (as indicated in FIG. 3). The threaded connection 37 of the nut with the inner sleeve permits relative adjustment of the nut to accommodate between it and the balls screw heads of various thicknesses.

Drive slots are provided in the head of the back-up nut for application of a proper tool for making adjustments of the nut. The adjustment is made before coupling the nosepiece to the tool.

The inner sleeve is formed with threads 42 on its outer surface which are engaged with internal threads of a screw travel or depth control nut 43 and of a lock-nut 44, the latter underlying the control nut. The peripheries or outer surfaces of nuts 43 and 44 slidably bear upon the inner surface of coupling 20. The return spring 27 is limited between an internal shoulder 45 of the control nut and an overhead shoulder 46 of the housing whereby the load of the spring is transmitted through the control nut to the inner sleeve.

Figure 6:
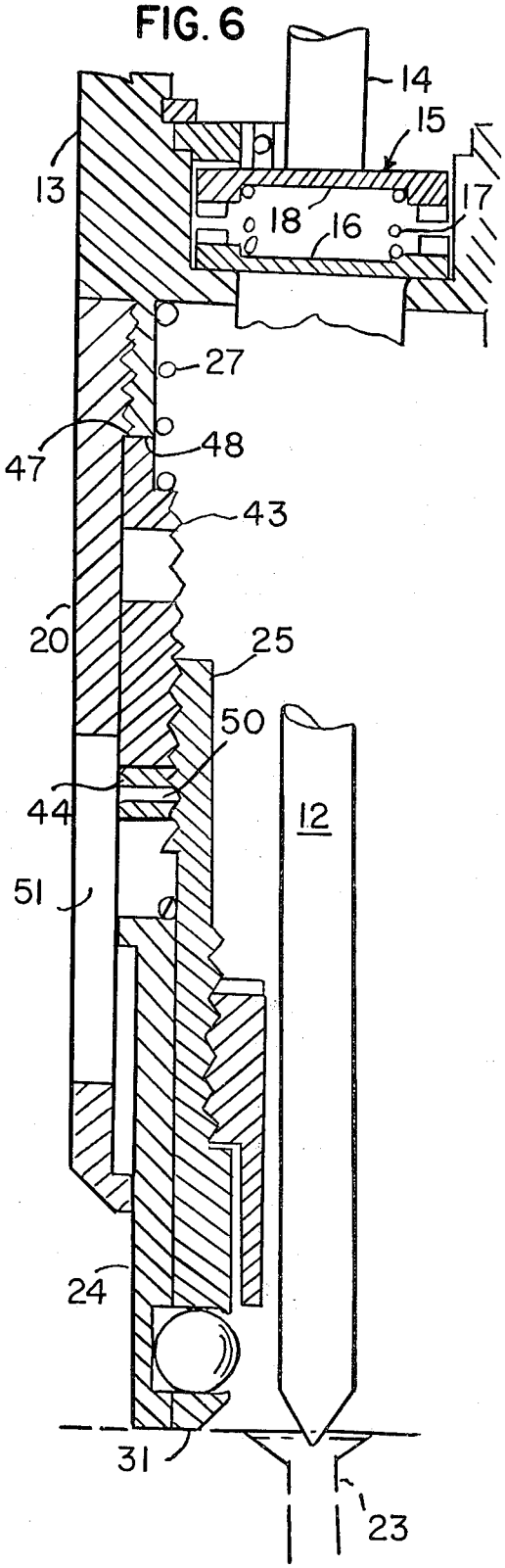
FIG. 6 is a detail showing the nosepiece in its final stage in the driving of the screw in which the screw is fully seated and the depth control nut has obtained a position preventing further entry of the screw into the work.

The control nut 43 and inner sleeve are axially slidable as a unit relative to coupling 20. The body of the control nut extends rearwardly beyond the rear end of the inner sleeve. The overall combined length of the control nut and inner sleeve is adjustable. To this end, the control nut is axially adjustable relative to the inner sleeve, so that at a predetermined time during an operation of the tool in driving a screw into a work surface, the rear end 47 of the control nut will cooperate with or abut a shoulder stop 48 of the housing of the tool to stop further forward travel of the tool just before the screw becomes finally seated. The driven clutch member then under the force of its spring momentarily overrides the driving clutch member to its disengaged condition, allowing the bit to finally seat the screw, as indicated in FIG. 6. A lock-nut 44 serves to lock the control nut in its adjusted position.

Adjustments may be made to the control nut before coupling the nosepiece to the housing. However, for the convenience of the operator an initial adjustment may be made of the control nut in this manner, and a finer or precise adjustment may be made after coupling of the nosepiece to the housing. For this purpose, the control nut is provided with a group of radial holes 49 about its side wall with which engagement may be had by means of a suitable adjusting tool entered through a group of openings or slots 51 (here three one being shown) in the side of the coupling. Holes 50 in the lock-nut 44 are similarly exposed through the openings 51 for turning the lock-nut as needed to lock the control nut in its adjusted position.

In summary of the operation of the nosepiece as improved by the screw travel or depth control feature: As a screw 23 is manually inserted head first into the inner sleeve through the front end of the nosepiece, its head is seated over the tip of the driving bit 12 and placed in contact with the undersurfaces of the protruding balls (as in FIG. 1). Further, inward manual insertion of the screw simultaneously slides the bit with the spindle 11 rearwardly against the bias of the clutch spring 17, and acts through the balls 33 to slide the inner sleeve 25 together with the elements connected to its rearwardly against the bias of the return spring 27. In this action, the inner sleeve is unseated from its pressed relation to the resilient O-ring 30. The latter in relaxing exerts a forward force upon the outer sleeve 24, serving to avoid movement of the latter rearwardly together with the inner sleeve. Normally, the looseness of the outer sleeve relative to the inner sleeve avoids such unitary movement. However, the O-ring action serves to ensure against such movement. As the balls become registered with the groove 34 in this rearward movement of the inner sleeve relative to the outer sleeve, the head of the rearwardly moving screw cams the balls aside into the groove (as shown in FIG. 2) sufficiently to enable it to be passed beyond them.

After the screw head is moved beyond the balls into the clearance 22 between the back-up nut 36 and the balls 33, and is next manually released by the operator, the return force of the relaxed spring 27 upon the inner sleeve dislodges the balls from the shallow groove 34 and returns the inner sleeve to obtain the locked position shown in FIG. 3, corresponding to its normal extended position. Upon return of the inner sleeve to the latter position, the balls again protrude into the nosepiece central passage, but now at the underside of the head of the screw. Also, as a consequence of the manual release of the screw, the driving bit moves forwardly under the bias of the clutch spring 17 to press and clamp the head of the screw firmly against the balls (as shown in FIG. 3).

With the screw now firmly gripped and locked in the FIG. 3 position in the nosepiece, and with the working end of the screw visibly projecting out of the nosepiece, the operator can, without fear of losing the screw, maneuver the tool about in any direction needed to precisely locate the screw relative to the work.

Figure 4:
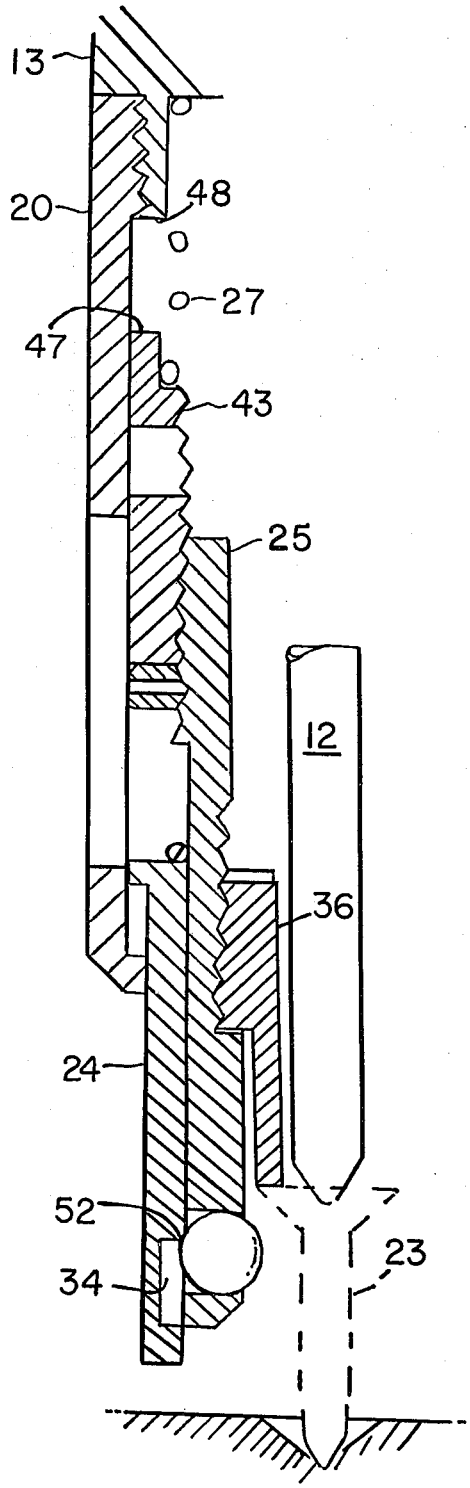
FIG. 4 is a detail showing the nosepiece in pressed relation to a screw preparatory to driving the screw into a work surface.

To next drive the screw into the work against which it has been positioned, the operator presses forwardly on the tool causing the housing 20 with the coupling 13 to move forwardly relative to the spindle and bit 11, 12 to engage the driving clutch member 18 with the driven clutch member 16 against the bias of the clutch spring 17. In this action, the return spring 27 forces the inner sleeve 25 forwardly until the back-up nut 36 limits against the head of screw 23. The balls are carried in this movement of the inner sleeve a corresponding distance clear of the underside of the head of the screw; and the loosely disposed outer sleeve 24 slides downwardly relative to the coupling and the inner sleeve until the upper annular edge 52 of its groove 34 limits or locks upon the several balls (as in FIG. 4). The outer sleeve in obtaining the latter position protrudes at its nose end slightly beyond the inner sleeve.

While continuing to exert a forward thrust upon the tool the operator activates the motor causing the driving bit 12 to drive the screw into the work. As the screw progressively enters the work, the housing and bit as a unit follow it.

Figure 5:
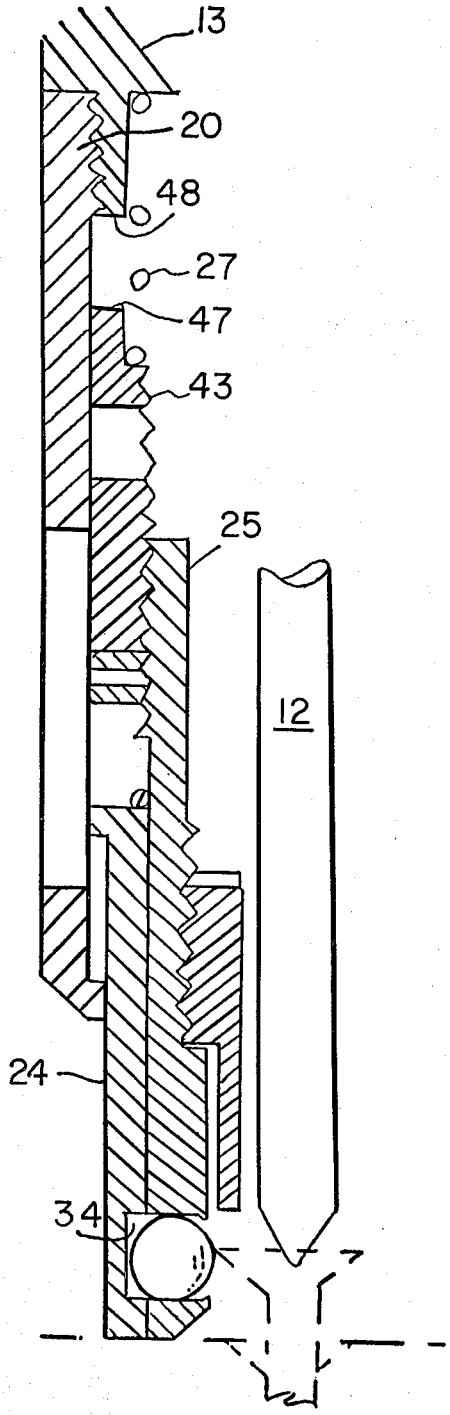
FIG. 5 is a detail showing the nosepiece at a stage in the driving of the screw in which the nosepiece has obtained an unlocked or ball released condition.

The back-up nut 36 serves to stabilize the screw during the initial stage of driving it into the work. As the screw progressively enters the work, the back-up nut follows it in spring loaded contact with its head. Eventually, as the tool is moving forwardly with the screw, the outer sleeve contacts the work surface and is forced upwardly to register its groove 34 with the balls, at which time the bottom ends of both sleeves will become level or flush with each other. Next, as the screw continues entering the work, both sleeves are retracted or forced by the work surface upwardly relative to the downwardly moving screw and housing of the tool. In this action, the balls are cammed by the screw out of its path into groove 34 (as shown in FIG. 5). The screw is then driven past the balls as the inner sleeve together with the outer sleeve continue to be retracted into the housing.

The adjustment made of the control nut 43 relative to the inner sleeve 25 and to the housing is such that at the time the end shoulder 47 of the control nut moves into abutment with the stop 48 of the housing, the screw will have reached a point short of being finally seated in the work. The arrested condition of the inner sleeve with the housing of the tool and the abutting relation of the nose end 31 of the inner sleeve with the work surface prevents further downward or axial travel of the tool. Whereupon this action, the driving clutch member overrides the driven clutch momentarily to its axially disengaged condition sufficiently to cause the bit to finally seat the screw, as in FIG. 6.

If during the driving action it should develop that the arrested condition of the shoulder 47 of the inner sleeve 25 with the stop 48 of the housing occurs before the screw can be fully seated by the bit, an adjustment of the control nut would be made to increase the space normally existing between the end shoulder 47 of the inner sleeve and the stop shoulder 48 of the housing. On the other hand, the adjustment would be made to decrease this space, if it develops that the screw is overseated into the work.

These adjustments normally will require only a slight angular turning of the lock-nut 44 and the adjustable depth control nut 43 in one direction or the other relative to the inner sleeve. While this adjustment could be made after disassembling the nosepiece from the housing, it would normally be made by engaging the lock-nut or the control nut, as needed, by means of a proper tool or implement, which may be the shank of a screw, through the side slots or openings 51 provided for that purpose and angularly moving it as needed in one direction or the other.

To avoid angular movement of the inner sleeve 25 together with the control and lock nuts 43, 44 during an adjustment action, suitable means which may take various forms is provided. Here, for this purpose a rod may be manually inserted through a hole 53 (FIG. 1) in the outer sleeve 24 and engaged with a slot 54 in the inner sleeve. Then, while manually holding the rod to restrain angular movement of the inner sleeve, angular adjustment of nuts 43, 44 may be readily made.

Following seating of the screw in the work and subsequent lifting of the tool from the screw, the components of the tool and nosepiece restore to normal.

The depth control feature is a means of providing a simple attachment to a standard positive clutch screw driver. This results in the use of a standard clutch to disengage at a preset travel of a screw head relative to the work. The seating relation of the head of the screw to the work surface is accordingly controlled by proper adjustments of the control and lock nuts. A further advantage is that the bit always stays engaged in the screw head, thereby avoiding damage and facilitating its future removal in case of repair. By having the adjustments nuts 43, and 44 internally of the housing, they are protected against damage during use of the tool or when resting the tool upon a surface. The slots in the outer housing facilitate quick adjustment of the nuts by using a standard screw as a tool, without the necessity of removing the housing.

I claim:

1. A screw driving tool comprising a housing, a screw driving bit supported in the housing so as to follow as a unit with the housing a screw as it is being driven by the bit into a work surface, a slide member supported by the housing for relative axial retractible movement having a normal position projecting axially beyond the housing and the bit and adapted to be retracted into the housing relative to the housing and bit upon being pressed into contact with a work surface, stop means carried by the housing having cooperation with the slide member to limit the extent of retraction of the slide member into the housing, the slide member being a sleeve disposed in the housing in surrounding relation to the bit, and adjustable means for controlling the extent of retraction of the slide member into the housing; wherein the adjustable means includes a travel control nut having threaded engagement with the sleeve and extending in its body axially rearwardly beyond the sleeve, the control nut being selectively operable to increase or decrease the overall length of the combined sleeve and control nut; and wherein the housing includes a side opening allowing access of a tool for making adjustments to the control nut.

2. A screw driving tool as in claim 1, including a lock nut threaded upon the sleeve adapted for locking adjusted positions of the control nut.

3. A screw driving tool as in claim 2, wherein the side opening allows access of a tool for making adjustments to the lock nut.

4. In a hand held power driven screw driving tool including a housing and a screw driving bit supported in the housing, a retractible nosepiece comprising an outer and an inner sleeve member disposed in axial slidable relation to each other, a coupling in which the inner and outer sleeves are supported for relative axial retraction and extension, the outer sleeve projecting axially through an open front end of the coupling and having a rear flange normally abutting upon an internal supporting shoulder of the coupling, the inner sleeve normally projecting axially out of a front end of the outer sleeve and having a rear flange overlying the rear flange of the outer sleeve, the coupling having a rear end detachably coupled to a front end of the housing and being in axial extension of the housing, the inner sleeve being disposed in coaxial surrounding relation to the driving bit, a spring biasing the inner sleeve in its normally projected relation to the outer sleeve and to the coupling, the inner sleeve being retractible into the coupling upon being pressured over its front end against a work surface, and stop means in the housing having cooperation with an end shoulder of the inner sleeve for arresting further retraction of the inner sleeve relative to the housing; wherein control means is provided for adjusting the length of the inner sleeve and thereby varying the extent of its retraction into the coupling; and wherein the control means is a control nut having threaded engagement with the inner sleeve and projecting in its body beyond the rear of the inner sleeve.

5. In a hand held power driven screw driving tool as in claim 4, wherein a lock nut having a threaded connection with the inner sleeve underlies the control nut for locking adjusted positions of the control nut relative to the inner sleeve.

6. In a hand held power driven screw driving tool as in claim 5, wherein the coupling is provided with a side opening allowing access of a proper tool for making adjustments of the control nut.

7. In a hand held power driven screw driving tool including a housing and a screw driving bit supported in the housing, a retractible nosepiece comprising an outer and an inner sleeve member disposed in axial slidable relation to each other, a coupling in which the inner and outer sleeves are supported for relative axial retraction and extension, the outer sleeve projecting axially through an open front end of the coupling and having a rear flange normally abutting upon an internal supporting shoulder of the coupling, the inner sleeve normally projecting axially out of a front end of the outer sleeve and having a rear flange overlying the rear flange of the outer sleeve, the coupling having a rear end detachably coupled to a front end of the housing and being in axial extension of the housing, the inner sleeve being disposed in coaxial surrounding relation to the driving bit, a spring biasing the inner sleeve in its normally projected relation to the outer sleeve and to the coupling, the inner sleeve being retractible into the coupling upon being pressured over its front end against a work surface, and stop means in the housing having cooperation with an end shoulder of the inner sleeve for arresting further retraction of the inner sleeve relative to the housing; a motor driven shaft, an upper driving clutch member carried by the shaft, a lower driven clutch member carrying the bit, a clutch spring normally disengaging the driven clutch member axially from the driving clutch member, the clutch members being engageable against the force of the spring upon pressuring the bit into engagement with a screw head, the driven clutch member being adapted following the arrest of the inner sleeve to angularly override the driving clutch member and move axially to a disengaged condition under the load of the clutch spring so as to impart a final degree of rotation to the bit and as a consequence to a screw engaged by the bit.

* * * * *